US005566938A

United States Patent [19]

MacDonald

[11] Patent Number: 5,566,938

[45] Date of Patent: Oct. 22, 1996

[54] ARTIFICIAL CURLING RINK

[75] Inventor: John A. MacDonald, Beaconsfield, Canada

[73] Assignee: Railtech Ltd., Baie d'Urfe, Canada

[21] Appl. No.: 420,568

[22] Filed: Apr. 12, 1995

[51] Int. Cl.[6] ..... A63B 67/14

[52] U.S. Cl. ..... 273/128 CS

[58] Field of Search ..... 273/126, 128, 273/57.2

[56] References Cited

U.S. PATENT DOCUMENTS

| | | | |
|---|---|---|---|
| 2,924,455 | 2/1960 | Brunel . | |
| 3,497,211 | 2/1970 | Nagin . | |

FOREIGN PATENT DOCUMENTS

| | | | |
|---|---|---|---|
| 670916 | 9/1963 | Canada | 273/126 R |
| 2025570 | 3/1992 | Canada | 273/128 CS |
| 2086130 | 6/1993 | Canada | 273/57.2 |
| 241857 | 1/1987 | German Dem. Rep. | 273/128 CS |
| 2506181 | 8/1976 | Germany | 273/128 CS |
| 636016 | 5/1983 | Switzerland | 273/128 CS |

*Primary Examiner*—Raleigh W. Chiu
*Attorney, Agent, or Firm*—William R. Hinds

[57] ABSTRACT

An artificial curling surface comprised of a rectangular-shaped sheet of plastic is disclosed. The sheet of plastic has a target zone and a hack at each end thereof. The sheet of plastic has a pebbled surface adapted to emulate ice pebbles on a sheet of ice of a curling rink. A curling rock having a replaceable gliding face can be used with the artificial curling surface. The replaceable gliding face of the curling rock is made of low-friction plastic having a density lower than the density of the plastic sheet.

20 Claims, 2 Drawing Sheets

ARTIFICIAL CURLING RINK

FIELD OF THE INVENTION

This invention relates to the sport of curling, but more particularly to an artificial curling surface and rock.

BACKGROUND OF THE INVENTION

Curling is a game played on ice by sliding curling rocks or stones across an ice rink towards a target zone or circle. A curling rock is a round stone up to 36 inches in circumference and weighing up to 50 pounds. The stone is flattened at the top and bottom and is provided with a handle on the top to enable a player to push the stone across the rink towards the target zone.

Ice curling is conducted on a sheet of ice that is 146 feet long and 14 feet 2 inches wide. The surface of the ice is pebbled to decrease friction between the bottom of the stone and the ice surface. These pebbles are formed by a sprinkler which sprays water on the ice to create the pebbles. The ice is divided into sections or end zones, so that the stones are delivered from one end towards another and vise versa. A hack is an indentation in the ice providing the player with a stable foot rest to push the rock towards the other end. Hacks are located at each end of the ice. Players are provided with sixteen curling stones and sweeping brushes or brooms for each player. The game is played by two teams each consisting of four curlers. Each curler delivers two rocks towards each end.

During the game, if it is desired to make the curling stone move further down the ice, the sweepers, usually two, will sweep or brush in front of the stone. This sweeping or brushing action is intended to melt the tips of the pebbles and thus reduce friction to allow the rock to move further towards the target zone. It is estimated that good sweepers can have a rock move twenty to thirty feet farther.

The problem associated with the existing game of ice curling, is that special conditions are required to maintain the ice surface to a near ideal condition. First, indoor rinks must be provided with special cooling equipment to maintain the ice at the right temperature. In addition, special sprayers are required to provide the pebbles on the ice surface. These ideal conditions can only be maintained inside a building having a costly refrigeration system, piping, and sprayer. After each game, the pebbled surface of the curling rink has to be re-sprayed to reform the pebbles damaged in the previous game. In addition, although the sport can be played all year long, it is limited to indoor facilities having the above mentioned cooling equipment.

Accordingly, a need exists to provide a new curling sheet and stone which is virtually maintenance-free and can be played year round outside and inside a building.

The above requirements can be met by the use of the curling sheet and stone of the present invention.

In particular, it is an object of the present invention to provide a curling sheet and stone which requires no refrigeration system or piping normally associated with ice curling.

Another object of the present invention is to provide a curling sheet and stones which can be played year round indoor or outdoor.

In accordance with a first embodiment of the present invention, there is provided an artificial curling surface comprising a rectangular-shaped sheet of plastic, said sheet of plastic having a target zone and a hack at each end thereof, said sheet of plastic having a pebbled surface adapted to emulate ice pebbles on a sheet of ice on a curling rink.

In accordance with a second embodiment of the present invention, there is provided a curling rock for use on a low-friction, high-density plastic sheet, said curling rock having a replaceable gliding face made of low-friction plastic of a density lower than the density of said plastic sheet.

According to a third embodiment of the present invention, there is provided in combination, an artificial curling surface comprising a rectangular-shaped sheet of plastic, said sheet of plastic having a target zone and a hack at each end thereof, said sheet of plastic having a pebbled surface adapted to emulate ice pebbles on a sheet of ice of a curling rink and a curling rock having a replaceable gliding face made of low-friction plastic having a density lower than the density of said plastic sheet.

BRIEF DESCRIPTION OF THE DRAWINGS

The invention will be better understood by an examination of the following description, together with the accompanying drawings, in which:

Referring now to FIG. 1*a*, we have shown at reference numeral 10, a top view of one end of the artificial curling sheet of the present invention. Since each end is identical, only one end is shown for sake of clarity. According to a first embodiment of the present invention, the curling sheet is made of a high-density, low-friction plastic of the same dimensions as a standard ice curling sheet. That is, 146 feet long by 14 feet 2 inches wide. A target zone 11 is painted at each end of the curling sheet, as would be provided on an curling ice sheet. A hack 12 is placed in the plastic surface so that the curler has a place to put the toe of his shoe when rocks are thrown onto the surface. The hack gives the curler a leverage in order to throw and slide the rock to get it started in motion.

FIG. 1*b* is a close-up view of the surface of the artificial curling sheet of the present invention. A series of pebbles 15 are provided to emulate the ice pebbles provided on a standard curling ice sheet. Normally, when curling, sweeping in front of the stone will enable the curling stone to move further down the ice surface. This sweeping or brushing action is intended to melt the tips of the pebbles and thus reduce friction to allow the rock to move further. In the present invention, the sweeping action would be to apply or moisten the tip of the pebble of the plastic ice sheet to reduce the amount of friction between the rock and the pebbles on the plastic sheet. Although the pebbles shown have a tear drop shape, it will be known to those knowledgeable in the art that various shapes of pebbles can be used to provide the intended result.

Referring now to FIG. 2, we have shown a sectional view of a curling stone 20 according to another embodiment of the present invention. The curling stone 20 is basically shaped the same as a standard granite curling stone. However, it is made of steel casing and is adapted to receive a plastic ring sliding insert 21 and a plastic ring bumper insert 22. The plastic ring bumper insert protects the steel casing when one stone hits another. It is also adapted to provide the same bounce effect that a standard granite curling stone would have when two stones collide. Thus, the bumper is ideally made of a high density plastic resistant to shock and wear. A handle 23 is provided to enable the curling player to throw or slide the rock on the surface. The plastic ring sliding insert 21 is removable so that it can be replaced when the plastic starts to wear out. The plastic used for the sliding insert is made of low-friction plastic. However, it is of lower density than the density of the curling ice sheet so that the plastic ring insert can wear out instead of the surface of the ice sheet. The plastic ice sheet is made of a low-friction high-density polyethylene compound. The plastic used for the ring insert can be of a low-density polyethylene such as TEFLON™.

Figure 1A:
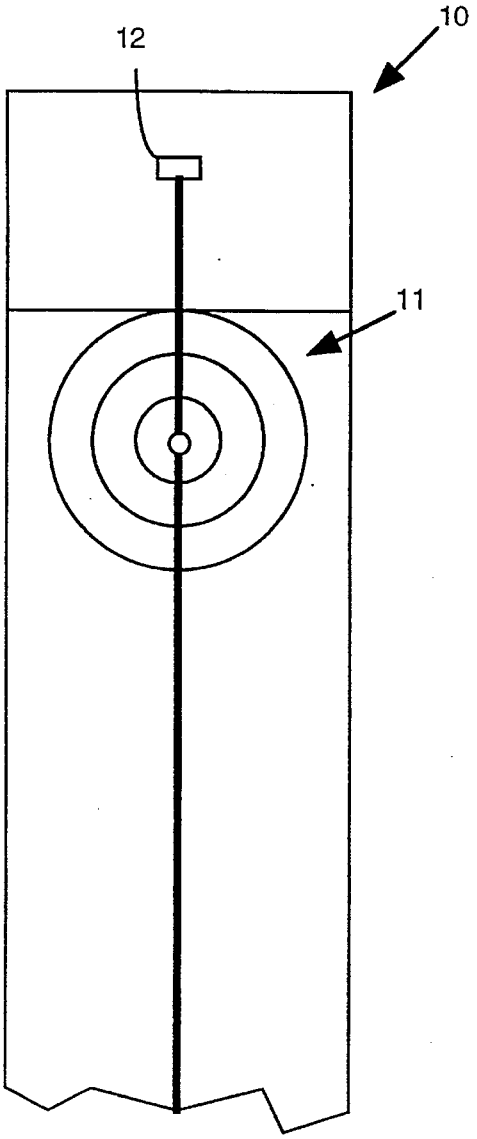
FIG. 1*a* is a diagram illustrating an artificial curling ice sheet according to the present invention.
Figure 1B:
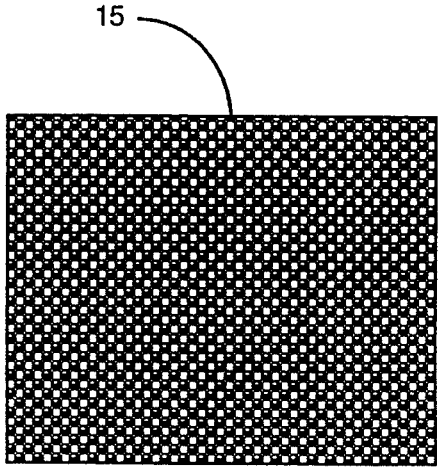
FIG. 1*b* is a close view of the surface of the artificial curling sheet according to a first embodiment of the present invention.
Figure 2:
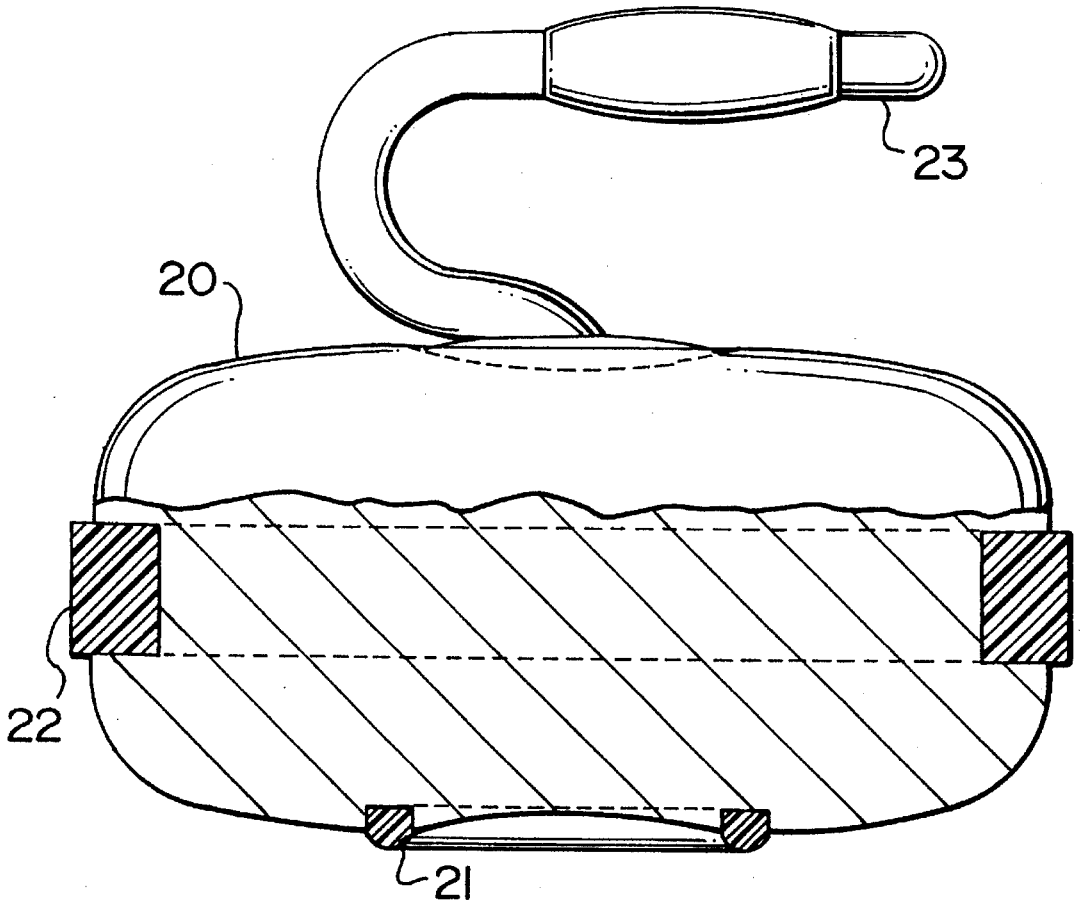
FIG. 2 is a section view of a curling stone according to an embodiment of the present invention.

The plastic curling ice sheet can be made using a hot press having a corrugated surface to enable the formation of the pebbles 15.

From the foregoing, it is evident that there are a number of ways in which the artificial curling sheet and curling stone can be made. Variations of the particular embodiment herewith described will be obvious to one skilled in the art, and accordingly the embodiment is to be taken as illustrative rather than limitive, the true scope of the invention being set out in the appended claims.

I claim:

1. An artificial curling surface comprising a rectangular-shaped sheet of plastic, said sheet of plastic having a target zone and a hack at each end thereof, said sheet of plastic having a pebbled surface adapted to emulate ice pebbles on a sheet of ice of a curling rink.

2. An artificial curling surface as defined in claim 1, wherein said sheet of plastic is made of a low-friction high-density plastic.

3. An artificial curling surface as defined in claim 2, wherein said plastic is comprised of polyethylene high-density plastic.

4. An artificial curling surface as defined in claim 1, wherein said target zone is painted on said sheet of plastic.

5. An artificial curling surface as defined in claim 1, wherein said pebbles are shaped to provide a lower friction coefficient when water is added thereto.

6. An artificial curling surface as defined in claim 5, wherein said pebbles are tear-drop shaped.

7. The combination of the artificial curling surface of claim 1 and a curling rock having a replaceable gliding face made of low-friction plastic having a density lower than the density of said plastic sheet.

8. The combination defined in claim 7, wherein said gliding face is made of low-density plastic.

9. The combination defined in claim 8, wherein said curling rock is comprised of a body having a top and a base, said body being made of steel casting and having an annular bumper, said base being adapted to receive a removable gliding face.

10. In combination, a low-friction high-density plastic sheet and a curling rock for use on the plastic sheet, said curling rock having a replaceable gliding face made of low-friction plastic of a density lower than the density of said plastic sheet.

11. The combination as defined in claim 10, wherein said curling rock is comprised of a body having a top and a base, said body being made from steel casting and having an annular bumper, said base being adapted to receive a removable gliding face.

12. The combination defined in claim 11, wherein said gliding face is made of low-density plastic.

13. In combination, an artificial curling surface comprising a rectangular-shaped sheet of plastic, said sheet of plastic having a target zone and a hack at each end thereof, said sheet of plastic having a pebbled surface adapted to emulate ice pebbles on a sheet of ice of a curling rink and a curling rock having a replaceable gliding face made of low-friction plastic having a density lower than the density of said plastic sheet.

14. The combination as defined in claim 13, wherein said sheet of plastic is made of a low-friction high-density plastic.

15. The combination as defined in claim 14, wherein said plastic is comprised of polyethylene high-density plastic.

16. The combination as defined in claim 13, wherein said target zone is painted on said sheet of plastic.

17. The combination as defined in claim 15, wherein said pebbles are shaped to provide a lower friction coefficient when water is added thereto.

18. The combination as defined in claim 17, wherein said pebbles are tear-drop shaped.

19. The combination as defined in claim 13, wherein said gliding face is made of low-density plastic.

20. The combination defined in claim 19, wherein said curling rock is comprised of a body having a top and a base, said body being made of steel casting and having an annular bumper, said base being adapted to receive a removable gliding face.

* * * * *